US010807255B1

(12) United States Patent
Rodriguez

(10) Patent No.: US 10,807,255 B1
(45) Date of Patent: Oct. 20, 2020

(54) HAIR TRIMMER ACCESSORY APPARATUS AND METHOD

(71) Applicant: Angel Luis Rodriguez, Kearny, NJ (US)

(72) Inventor: Angel Luis Rodriguez, Kearny, NJ (US)

( * ) Notice: Subject to any disclaimer, the term of this patent is extended or adjusted under 35 U.S.C. 154(b) by 0 days.

(21) Appl. No.: 16/443,048

(22) Filed: Jun. 17, 2019

Related U.S. Application Data

(60) Provisional application No. 62/831,098, filed on Apr. 8, 2019.

(51) Int. Cl.
*B26B 19/38* (2006.01)
*B26B 19/04* (2006.01)

(52) U.S. Cl.
CPC ..... *B26B 19/3853* (2013.01); *B26B 19/04* (2013.01)

(58) Field of Classification Search
CPC ..... B26B 19/3853; B26B 19/04
See application file for complete search history.

(56) References Cited

U.S. PATENT DOCUMENTS

2003/0037441 A1* 2/2003 Butcher ..... B26B 19/3853 30/233
2005/0015997 A1* 1/2005 Roble ..... B26B 19/3813 30/232
2016/0354938 A1* 12/2016 Atkins ..... B26B 19/28

* cited by examiner

*Primary Examiner* — Stephen Choi
(74) *Attorney, Agent, or Firm* — Walter J. Tencza, Jr.

(57) ABSTRACT

An electrical hair trimmer including a mounting device; a blade configured to be mounted to the mounting device; a housing; and a cap configured to be attached to and detached from the housing so that when attached to the housing the cap covers one or more openings at a top of the housing preventing debris from falling into an inner chamber of the housing. The mounting device may project outward from the housing; and the cap may have a first opening which allows it to be slipped on to the housing, over the mounting device to cover the one or more openings at the top of the housing, and allows the cap to be slipped off of the housing, by passing the mounting device through the first opening; and the mounting device projects outwards from the cap through the first opening when the cap is attached.

14 Claims, 12 Drawing Sheets

HAIR TRIMMER ACCESSORY APPARATUS AND METHOD

CROSS REFERENCE TO RELATED APPLICATION(S)

The present application claims the priority of U.S. provisional application Ser. No. 62/831,098 filed on Apr. 8, 2019, inventor and applicant Angel Luis Rodriguez.

FIELD OF THE INVENTION

This invention relates to accessories for hair trimmers, electric trimmers, or electric razors.

BACKGROUND OF THE INVENTION

It is known in the art, that electric hair trimmers, such as Andis (trademarked) T-Outliner (trademarked) are frequently modified by users by cutting off the top of their housings, to allow the trimmers to more closely shave areas of a person which are difficult to reach. However, after removal of a top part of a housing gaps are opened leading to an inner chamber of the remaining housing and to mechanical and/or electrical components. The cutting off of the top part may result in hair undesirably get into mechanical and/or electrical components within an inner chamber of the remaining housing. There is a need to provide a device allowing close trimming but also protecting inner components.

SUMMARY OF THE INVENTION

At least one embodiment of the present invention provides a device that stops hair from getting into a hair trimmer. The hair trimmer may be a modified Andis (trademarked) T-Outliner (trademarked hair trimmer, where the top of an Andis (trademarked) T-Outliner hair trimmer has been cut off to allow the hair trimmer to shave more closely, and the has been replaced with an accessory, covering, or shield in accordance with the present invention. The accessory, covering or shield of an embodiment of the present invention may slide over the modified hair trimmer in a glove manner and may hold snug to the trimmer's body.

The accessory, covering, or shield, in at least one embodiment of the present invention is keeps the modified trimmer safe from wear and tear by being a shield to the exposed opening and stopping debris from entering into housing of the modified trimmer. The accessory, covering or shield also finalizes and completes the closure of the housing giving the housing full coverage and completeness. In at least one embodiment, the accessory, covering or shield may also provide grip, décor, and comfort to the modified trimmer and also may allow for personalization and the ability to have a better hold on to the trimmer's body or housing.

In at least one embodiment, an electrical hair trimmer is provided comprising a mounting device; a blade mounted configured to be mounted to the mounting device; a housing; and a cap configured to be attached and detached from the housing so that when it is attached to the housing it covers one or more openings at a top of the housing and thereby prevents debris falling into an inner chamber of the housing In at least one embodiment, the mounting device projects outwards from the housing; and the cap has a first opening which allows the cap to be slipped on to the housing, by passing the mounting device through the first opening to cover the one or more openings at the top of the housing, and allows the cap to be slipped off of the housing, by passing the mounting device through the first opening; and the mounting device projects outwards from the cap through the first opening when the cap is attached to the housing, so that the cap covers one or more openings at the top of the housing.

In at least one embodiment the cap has a top, and a periphery which surrounds the top of the cap; and the periphery is configured to surround and attach to the housing.

The cap may have a second opening which allows a further device fixed to the housing to pass through the second opening of the cap while the mounting device passes through the first opening of the cap in order to attach the cap onto the housing, so that the cap covers one or more openings at the top of the housing.

In at least one embodiment, a method is provided which may include passing a mounting device of an electrical hair trimmer through a first opening of a cap, wherein the mounting device is configured to have a blade mounted on the mounting device; and attaching the cap to a housing of the electrical hair trimmer at a top of the housing so that the cap covers one or more openings at the top of the housing and thereby prevents debris falling into an inner chamber of the housing, and the mounting device projects outward from the cap and from the housing.

The method may also include passing a further device of the electrical hair trimmer through a second opening of the cap while the mounting device passes through the first opening of the cap in order to attach the cap onto the housing, so that the cap covers one or more openings at the top of the housing.

DETAILED DESCRIPTION OF THE DRAWINGS

Figure 1A:
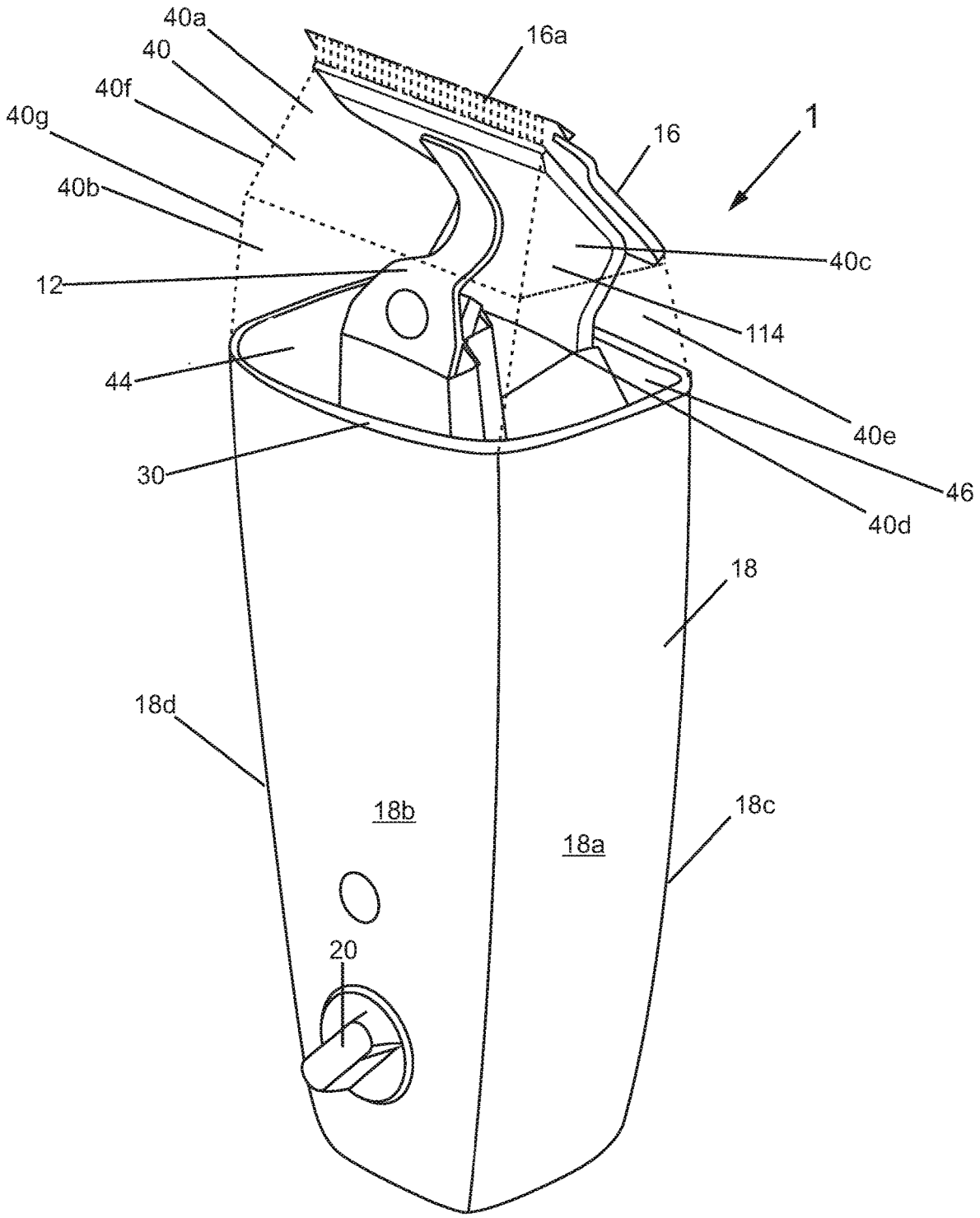
FIG. 1A (Prior art)
FIG. 1A is a right side, top, and front perspective view of a hair trimmer apparatus known in the prior art, where a top housing section is shown in dashed lines.
Figure 1B:
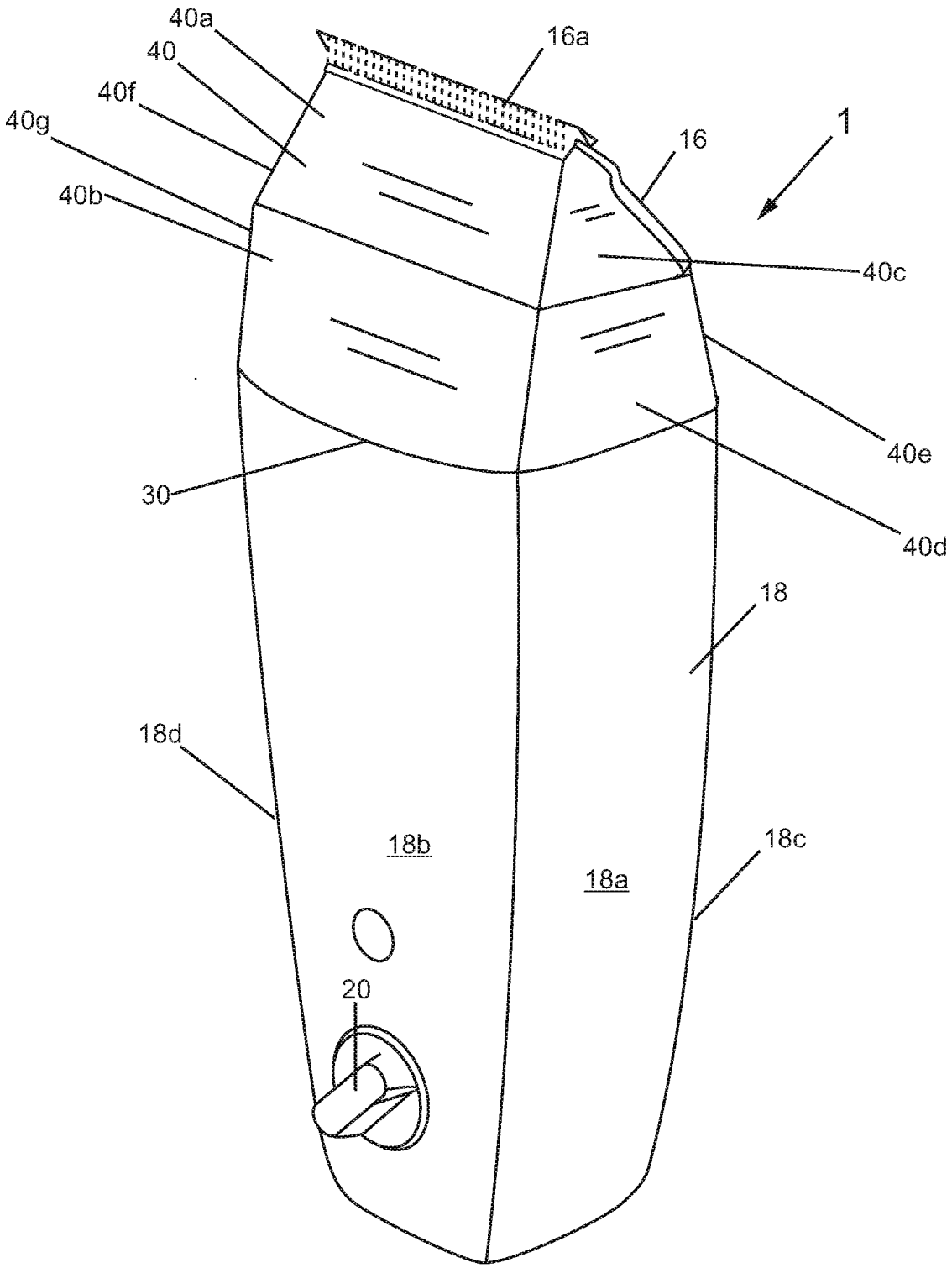
FIG. 1B (Prior art)
FIG. 1B is a right side, top, and front perspective view of a hair trimmer apparatus known in the prior art, where a top housing section is shown with solid lines.

Electric hair trimmers, such as Andis (trademarked) T-Outliner (trademarked) are frequently modified by users by cutting off the top of their housings, such as housing part 40, which includes sections 40*a*, 40*b*, 40*c*, 40*d*, 40*e*, and 40*f* shown by solid lines in FIG. 1B and by dashed lines in FIG. 1A of the known electric hair trimmer 1 shown in FIGS. 1A and 1B. The housing part 40, after being cut along the peripheral edge 30 all around the trimmer 1 is typically removed, as known in the prior art to allow a blade edge 16*a* of blade 16 to get closer for shaving and trimming hair. After removal of the housing part or portion 40, the trimmer 1 minus the housing part 40 appears as in FIG. 1A, but without part 40 represented by the dashed lines. The trimmer 1 minus the top part 40, has openings, such as openings 44 and 46 leading into an inner chamber of the housing part 18, and hair may undesirably get into mechanical and/or electrical components within the housing 18 damaging the trimmer 1 minus the housing part 40. Note that the apparatus 1, after removal of housing part 40, may be identical to the apparatus 100 shown in FIG. 2, except for the presence of an accessory, shield, or covering 50.

Figure 2:
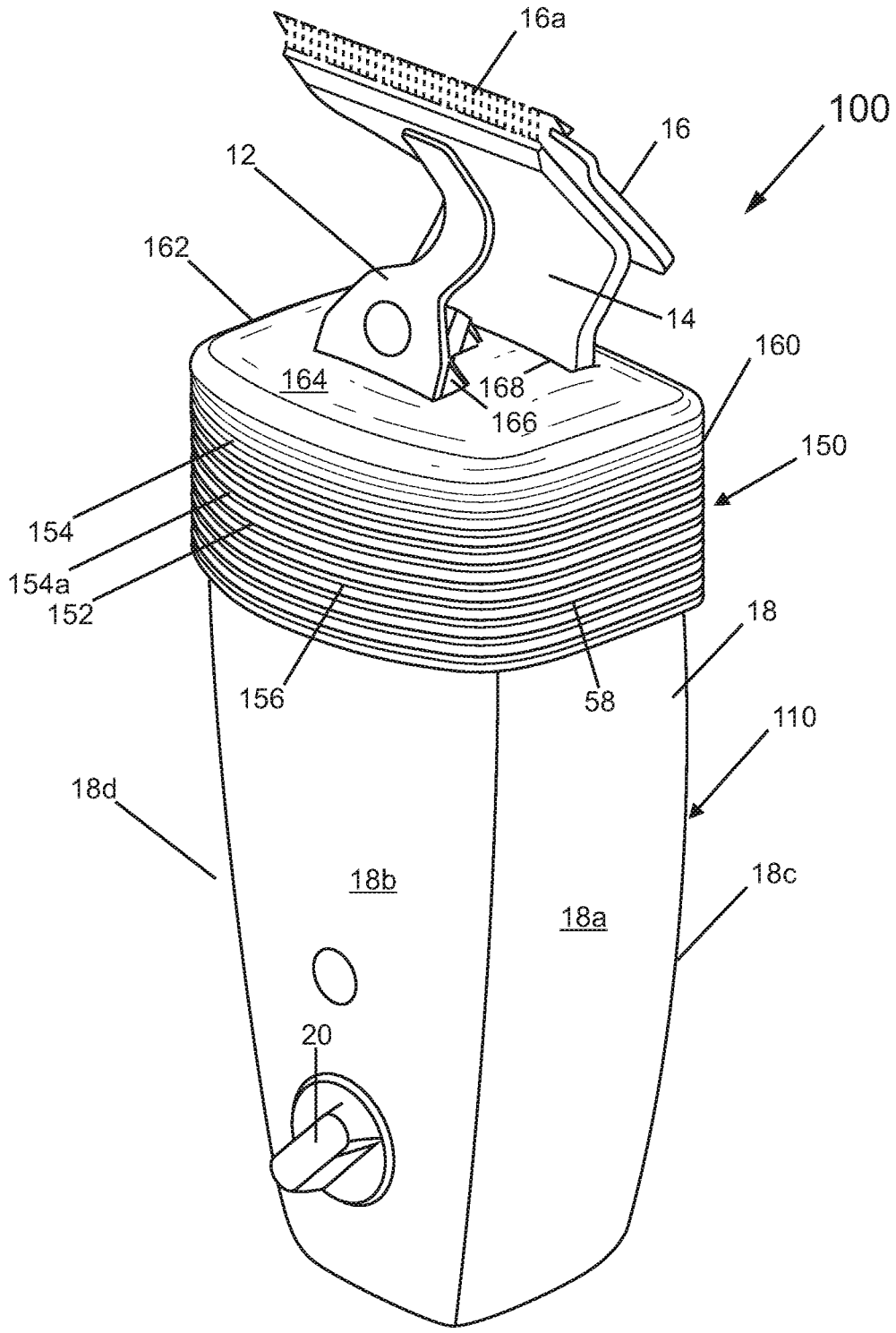
FIG. 2 is a right side, top, and front perspective view of an apparatus including a hair trimmer accessory attached to a hair trimmer in accordance with an embodiment of the present invention.
Figure 3:
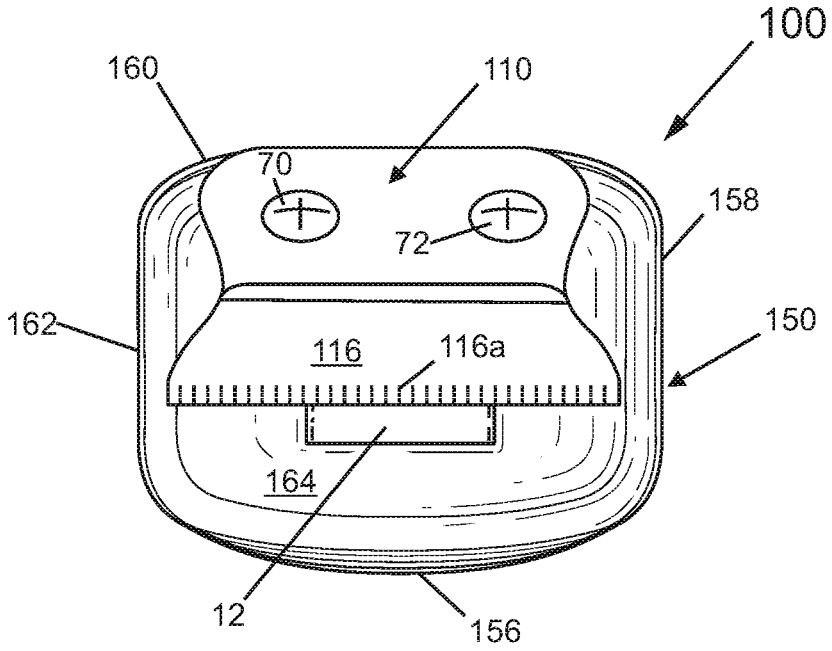
FIG. 3 is a top plan view of the apparatus of FIG. 2.
Figure 4:
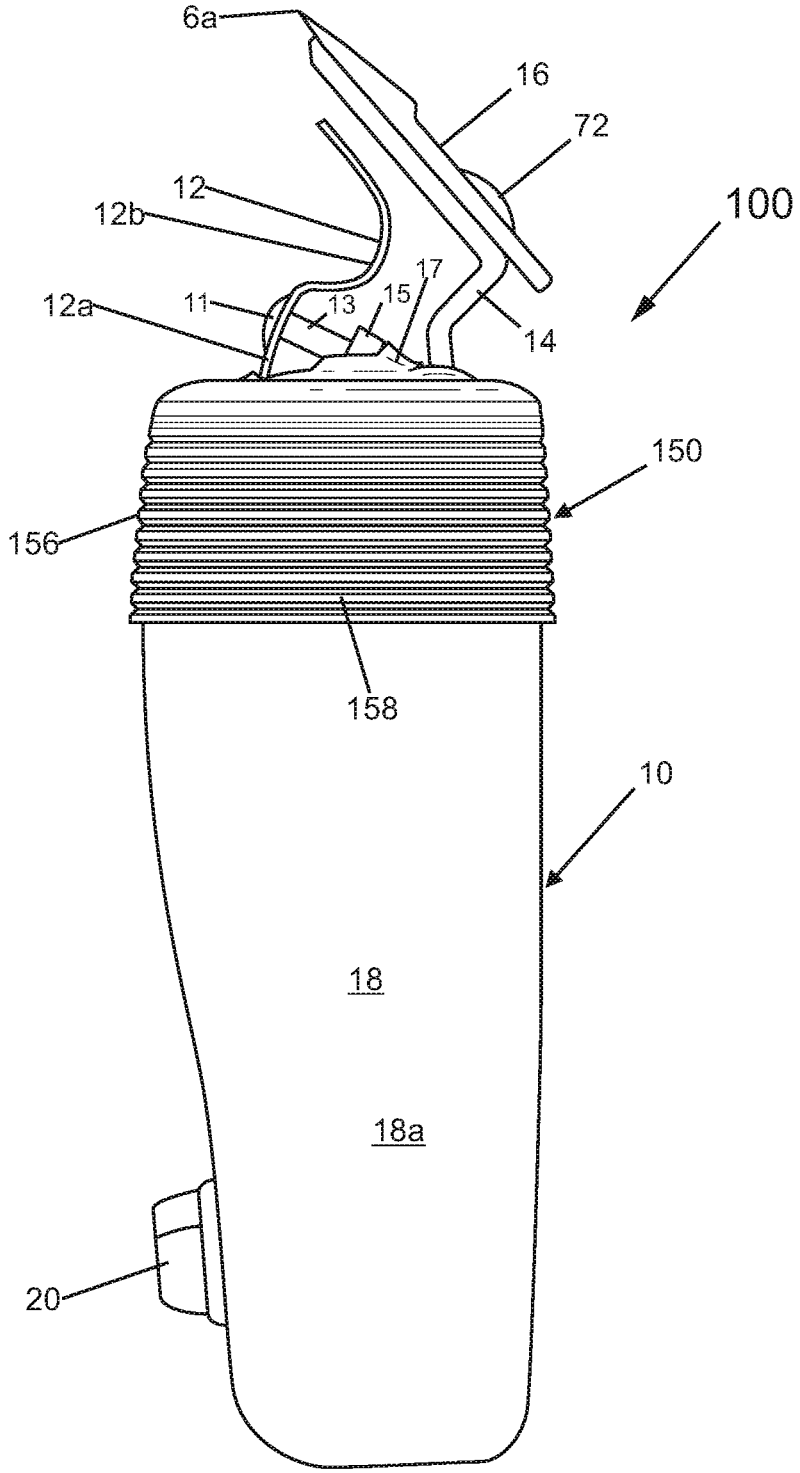
FIG. 4 is a right side elevational view of the apparatus of FIG. 2, wherein the left side is a mirror image of the right side.

FIG. 2 is a right side, top, and front perspective view of an apparatus 100 including a hair trimmer accessory 150 attached to a modified trimmer (the hair trimmer 1 minus part 40) in accordance with an embodiment of the present invention. FIG. 3 is a top plan view of the apparatus 100 of FIG. 2. FIG. 4 is a right side elevational view of the apparatus 100 of FIG. 2, wherein the left side is a mirror image of the right side.

Figure 5:
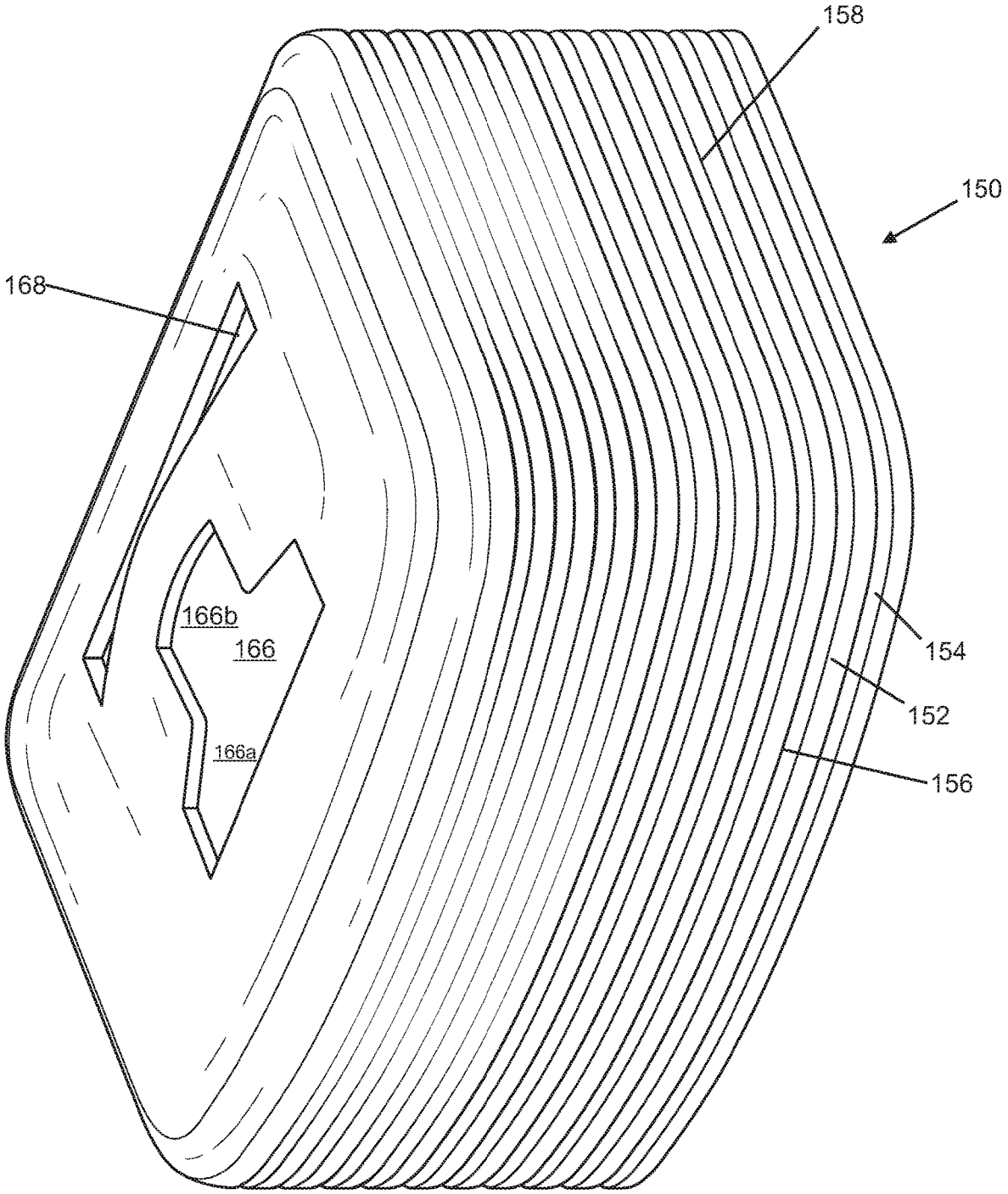
FIG. 5 a right, top, and front perspective view of the hair trimmer accessory of FIG. 2 unattached from the hair trimmer shown in FIG. 2.
Figure 6:
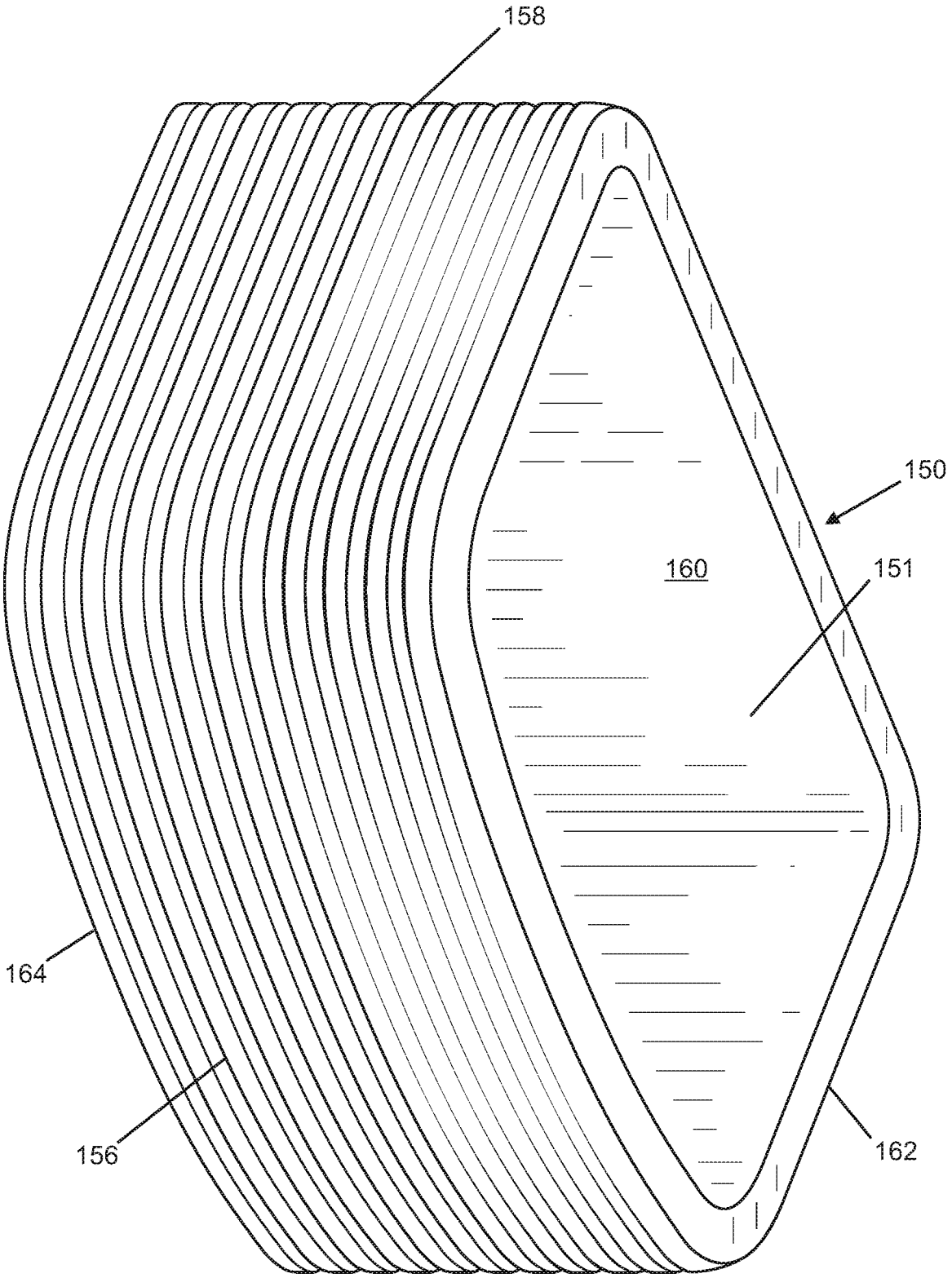
FIG. 6 is a bottom, front, and left side perspective view of the hair trimmer accessory of FIG. 2 unattached from the hair trimmer shown in FIG. 2.
Figure 7:
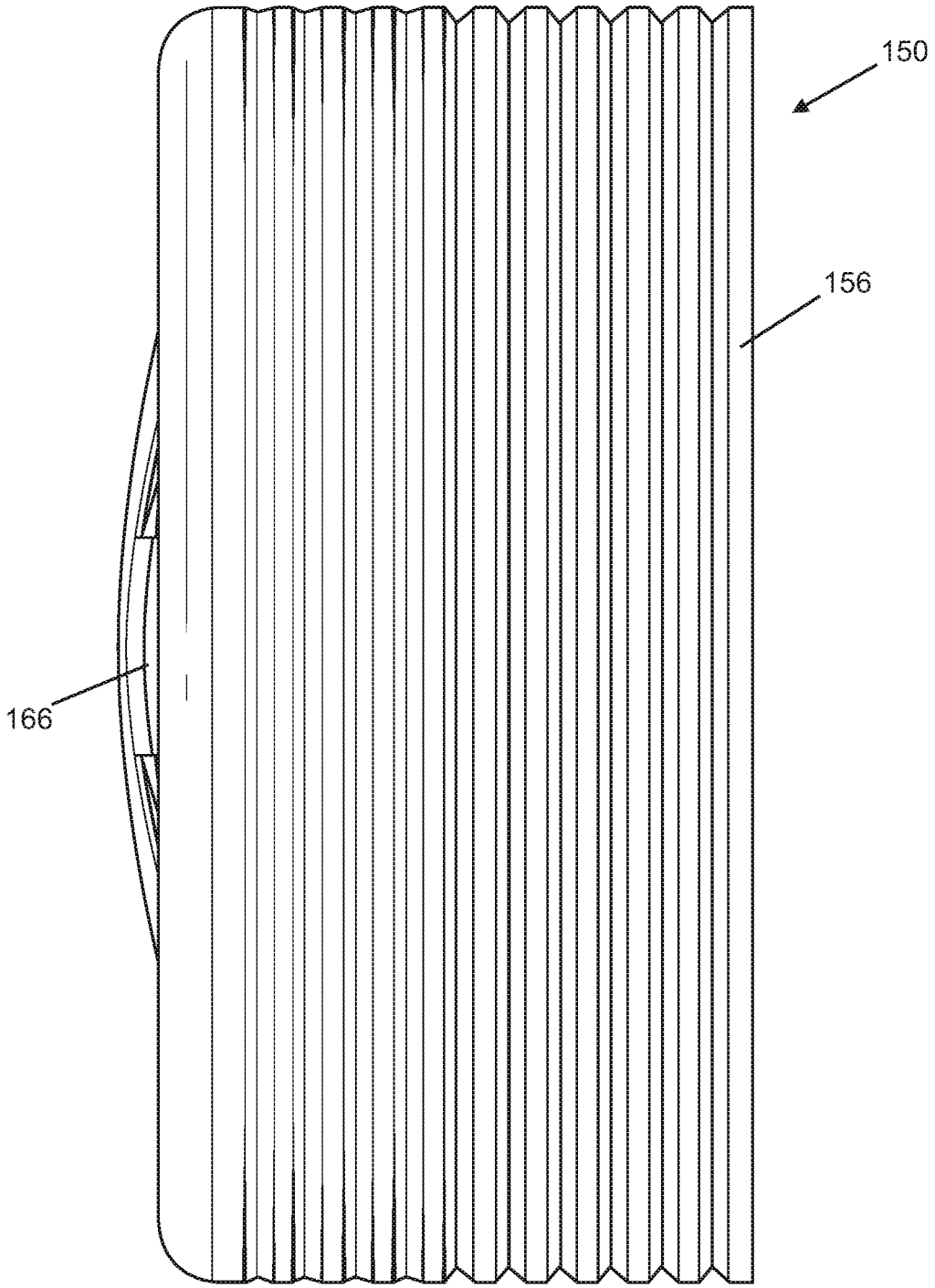
FIG. 7 is a front elevational view of the hair trimmer accessory of FIG. 2 unattached from the hair trimmer shown in FIG. 2.
Figure 8:
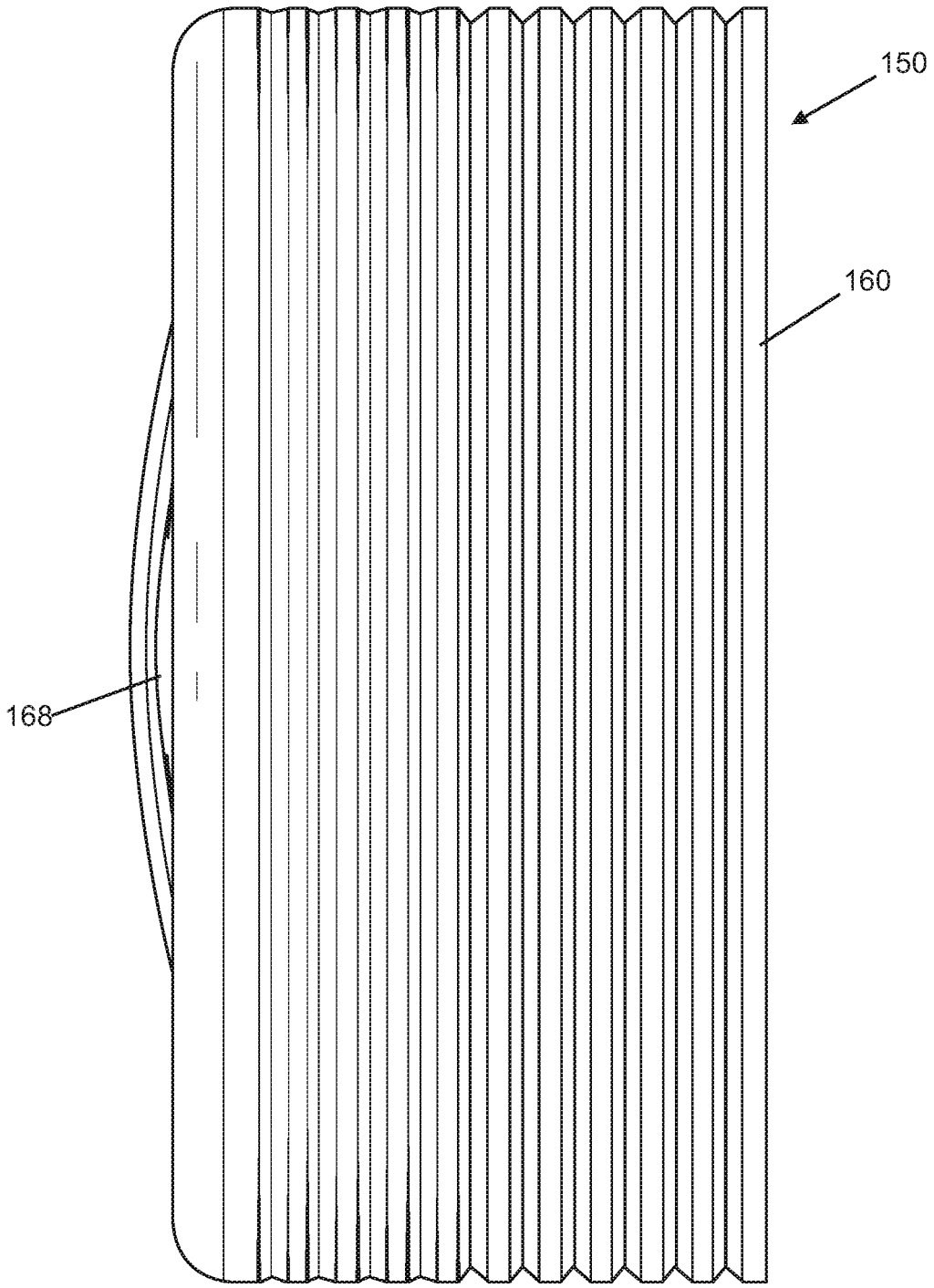
FIG. 8 is a rear elevational view of the hair trimmer accessor of FIG. 2 unattached from the hair trimmer shown in FIG. 2.
Figure 9:
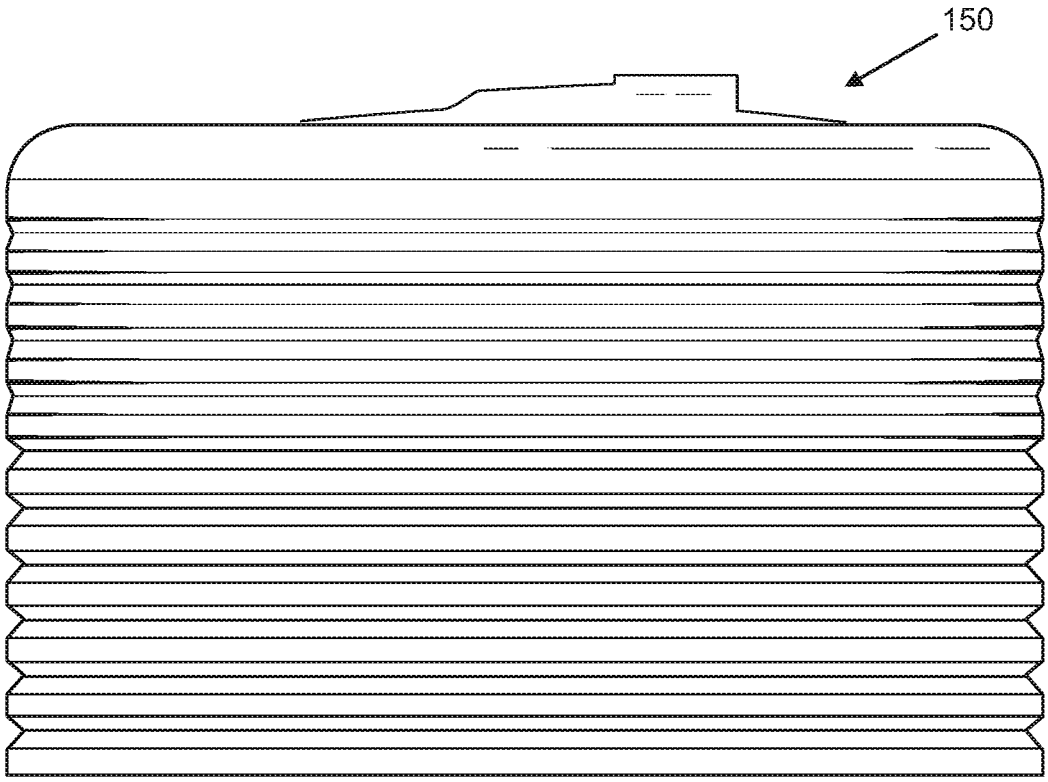
FIG. 9 is a right side elevational view of the hair trimmer accessory of FIG. 2, unattached from the hair trimmer of FIG. 2, wherein the left side is a mirror image of the right side.
Figure 10:
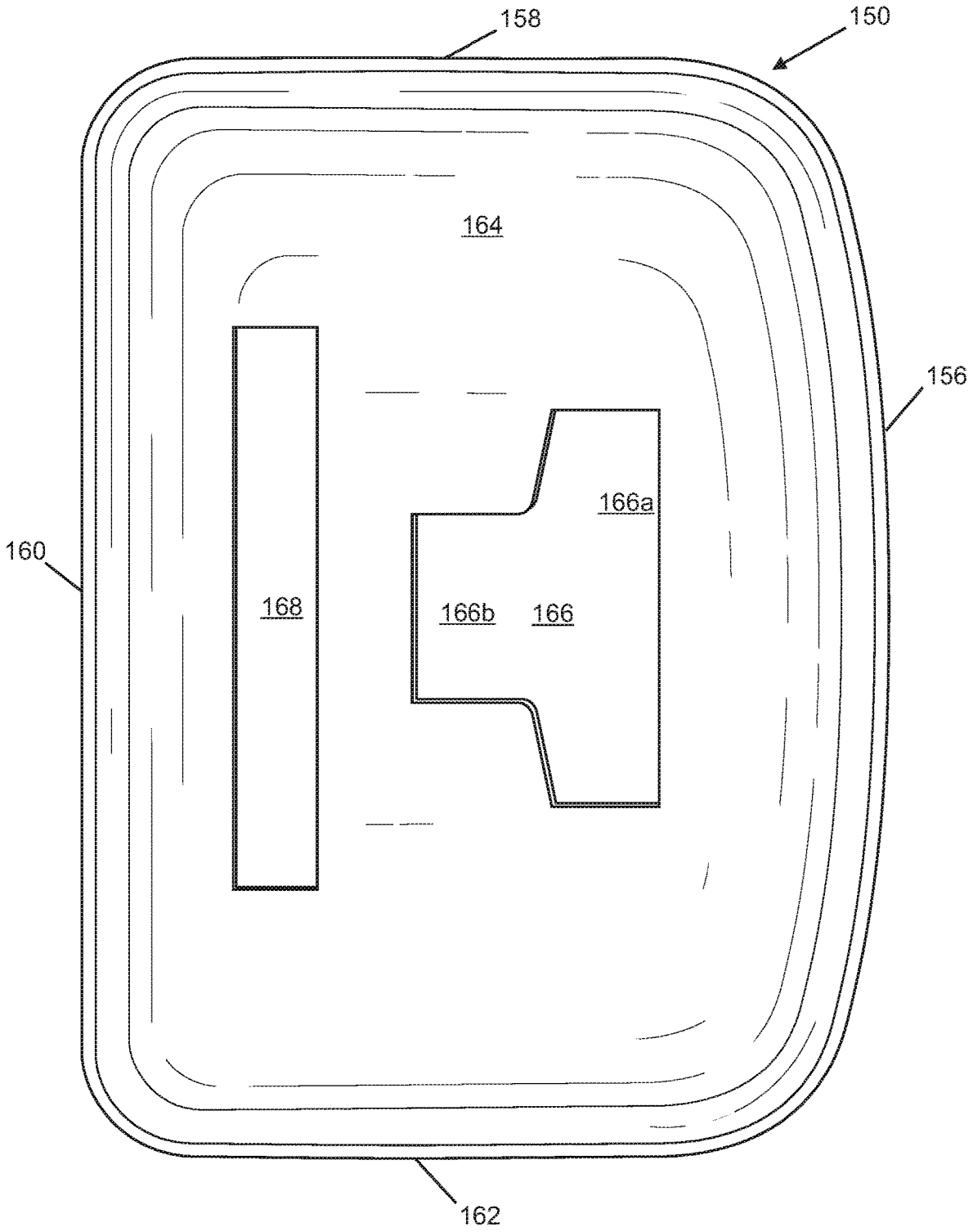
FIG. 10 is a top plan view of the hair trimmer accessory of FIG. 2, unattached from the hair trimmer of FIG. 2.
Figure 11:
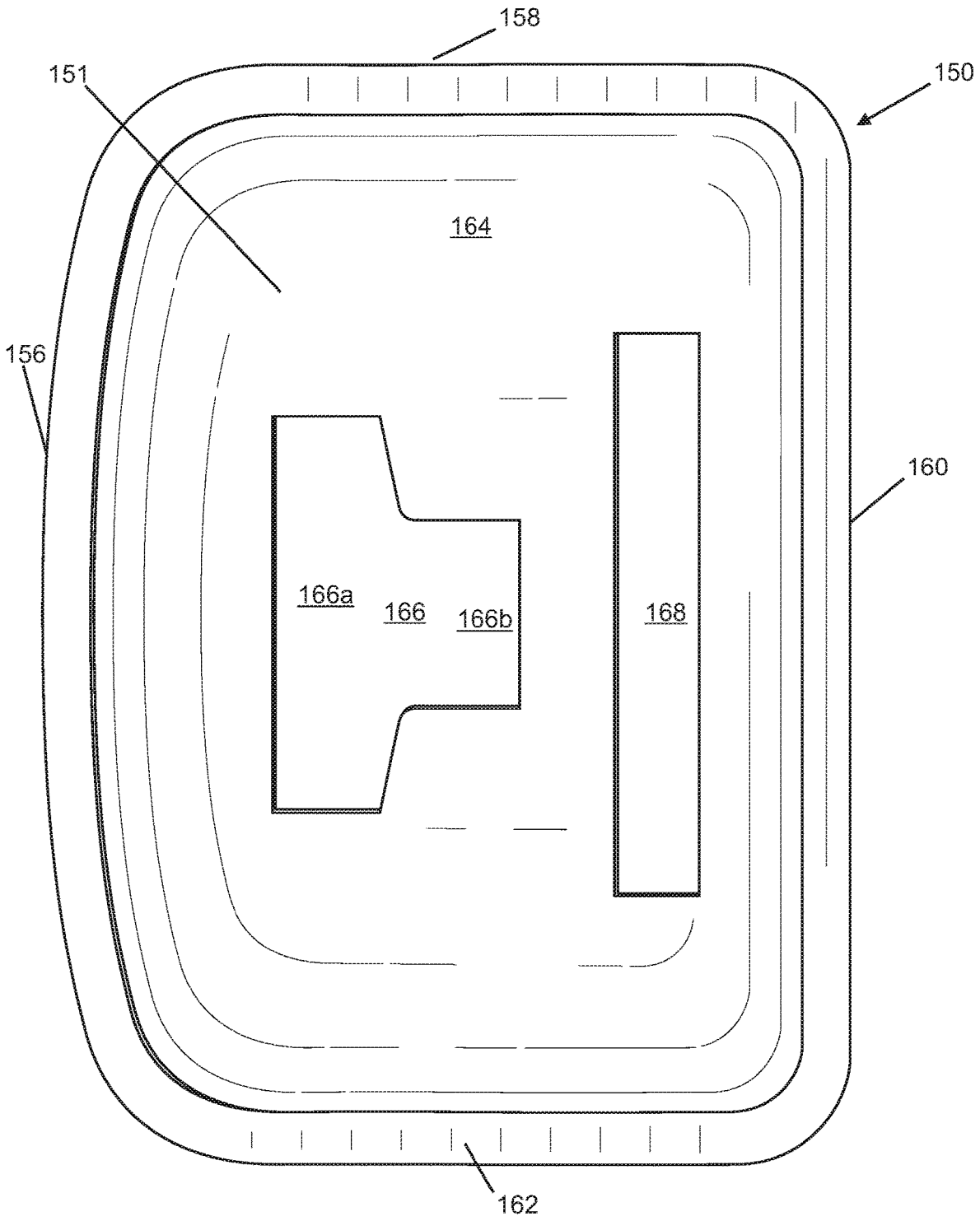
FIG. 11 is a bottom plan view of the hair trimmer accessory of FIG. 2, unattached from the hair trimmer of FIG. 2.

FIG. 5 a right, top, and front perspective view of the hair trimmer accessory 150 of FIG. 2 unattached from the modified trimmer (hair trimmer 1 minus the top part 40), shown in FIG. 2. FIG. 6 is a bottom, front, and left side perspective view of the hair trimmer accessory 150. FIG. 7 is a front elevational view of the hair trimmer accessory 150. FIG. 8 is a rear elevational view of the hair trimmer accessory 150. FIG. 9 is a right side elevational view of the hair trimmer accessory 150, wherein the left side is a mirror image of the right side. FIG. 10 is a top plan view of the hair trimmer accessory 150. FIG. 11 is a bottom plan view of the hair trimmer accessory 150.

The modified trimmer (hair trimmer 1 minus the part 40) may be one of various known hair trimmers, with a top part 40 of the housing removed and/or cut off. The hair trimmer 1 may include members 12 and 14, and blade 16 having sharp edge 16*a* as shown in FIG. 1A. The hair trimmer 1 may have a body or handle 18, which includes right side 18*a*, front side 18*b*, left side 18*d*, and rear side 18*c*. The blade 16 may be attached to member 14 by screws or fasteners 70 and 72 as shown in FIG. 3. The hair trimmer 1 may further include members 13, 15, and 17 shown in FIG. 4. The member 12 may be held in a fixed orientation and position by a combination of a fastener 11 and a member 13.

The hair trimmer 1 may include a motor within an inner chamber of the body or handle 18, which is used to cause the member 14 to vibrate in a known manner to cause the attached blade 16 to vibrate to trim hair.

The hair trimmer accessory 150 may include a periphery 152 which includes front side 156, right side 158, rear side 160, and left side 162. The periphery 152 may have ridges 154 including ridge 154*a* which is located on the entire periphery 152 and which help the hair trimmer accessory 150 to hold tightly onto the handle 18 of the hair trimmer 1 minus the part 40. The hair trimmer accessory 150 has a top 164 and openings 166 and 168. The opening 166 includes sections 166*a* and 166*b*.

The hair trimmer accessory 150 may be made substantially or entirely of rubber or other material which is elastic, but rigid, to hold tightly to the hair trimmer 1 minus the part 40.

In at least one embodiment, the member 12 is inserted through the opening 166 while the member 14 is inserted through the opening 168 to cause the hair trimmer accessory 50 to be placed on the hair trimmer 1 minus the part 40 as shown in FIG. 2. The hair trimmer accessory 150 can be taken off of the hair trimmer 1 minus the part 40, as desired.

The covering or part 40 may be removed or cut off from the top, such as cut off from the housing 18, so that a person can more closely trim hair with blade 16. Such a device has one or more openings at the top, such as opening 44 and 46 (when the accessory 50 is not located at the top of trimmer 10), which may allow hair to get into components of body, housing, or handle 18, such as a motor within an inner chamber of the housing or handle 18.

The accessory 150 thus protects the inner components within an inner chamber of the housing or handle 18.

The accessory, shield or covering 150, in at least one embodiment, may be a rectangular shaped cap with rounded corners at the junctions of sides 156 and 158, sides 158 and 160, sides 160 and 162, and sides 162 and 156. The accessory, shield, or covering 150 may be shaped and contoured to fit snug around the modified trimmer's body or housing 18, so the front panel or side 156 is arched in shaped.

The front side or panel 156 may have a word on it, such as a trademark which identifies a product.

In at least one embodiment, the bottom of the accessory, shield or covering 150 may be open as shown in FIG. 6, giving the covering 150 its cap or lid form.

The top or top panel 164 of the covering 150 may have a dash shaped cut-out or opening 168 on the top position of the top or top panel 164 with an upside-down "T" shaped cut-out or opening 166 under the dash shape cut-out or opening 168. These cut-outs or openings 166 and 168 in and/or through the top panel 164 are the openings that allow the modified trimmer's blade attachment assembly to pass through the present covering 150 so that the covering 150 can sit and fit onto the modified trimmer's body or housing 18, like a cap.

The covering 150 goes on to the modified trimmer housing 18, in the manner of a cap, and by removing the modified trimmer's blade 16 and then with the blade 16 removed from the trimmer 1 minus the part 40, the present invention can be slid over the blade attachment assembly components 12 and 14, to sit and fit snuggling onto the modified trimmer's encasement or housing 18.

In at least one embodiment, the covering 150 shields debris from entering the inner chamber surrounded by the housing 18 of the modified trimmer or trimmer 1 minus the part 40. The covering 150 completes the encasement or housing 18 of the modified trimmer (trimmer 1 minus the part 40) by re-covering the exposed opening caused by the modification of a known hair trimmer, such as Andis (trademarked) T-Outliner (trademarked). The covering 150 combines with the modified trimmer housing 18 to provide a better grip and feel for the person using apparatus 100, and provides a unique and custom look.

In at least one embodiment, the covering 150 may be comprised substantially or entirely of silicone, a polymer, plastic and or silicone based material.

The covering 150 may have a length, for the dimension of front side 156, of about one and three quarters inches, and the length may be about the same or slightly less than the corresponding width of side 18*b* of the housing 18 to provide a tight fit. The covering 150 may have width for the dimension of side 158 which is approximately one and one quarter inches, and this may be about the same or slightly less than the corresponding width of side 18*a* or 18*d*. The covering 150 may have a height which may be approximately seven-eighths inches. The height needs to be sufficient to cover all or substantially all of the area of a housing a non modified trimmer which has been cut off at the top, leaving behind housing 18. These dimensions are critical in at least one embodiment to provide a snug, secure fit, to prevent debris from entering an inner chamber of housing 18, and to minimize the amount of material required.

The surrounding panels or sides 156, 158, 160, and 162 may have ridge-like lines laid in a horizontal manner around the entire body of the accessory or covering 150 for better grip to the touch. However, the top panel 164 may not have ridges.

On the top or top panel 164 of accessory or covering 150 there is an opening 168 resembling a dash centered on the higher portion of the top or top panel 164 as shown in FIG. 5 and directly below is an opening resembling as upside down "T" as shown by FIG. 5.

On the underside of the covering 150 is the open end exposing the inner chamber or inside of the cap-shaped covering 150. The top 164 length of the covering 150 may be approximately a centimeter or so more than the bottom length of the covering 150's measurements. This also applies to the width's measurements. The reason for these asymmetrical attributes is so the hold of the present invention to the housing 118 of the modified trimmer (trimmer 1 minus part 40) can be snug and have a firm fit.

In at least one embodiment, the covering 150 keeps the modified Andis (trademarked) Outliner (trademarked) trimmer protected and free of debris from entering its housing by re-covering the encasement or housing of the trimmer's body (after it has been cut off) and completing the cover of the newly exposed area left by the modification of the Andis (trademarked) Outliner (trademarked) trimmer.

In at least one embodiment, the present invention provides a cover, accessory or shield 150 go overs a modified Andis (trademarked) Outliner (trademarked) trimmer to protect the exposed area left behind by the removal, or cutting off of the top portion of the trimmer's encasement or housing once it has been modified. One or more embodiments of the invention solves the problem by re-covering the open area yet keeping the preferred features. The present invention gives the operator of the trimmer a new grip to hold onto better for the modified trimmer while giving the modified trimmer a professional finish.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An electrical hair trimmer comprising:

a mounting device;

a blade configured to be mounted to the mounting device;

a housing; and a cap comprising a front side, a rear side, a left side, a right side and a top, wherein the top is fixed to the front side, the rear side, the left side, and the right side, so that the top protrudes inwards from the front side, the rear side, the left side, and the right side;

wherein the cap is configured to be attached and detached from the housing so that when the cap is attached to the housing the top of the cap covers one or more openings at a top of the housing, while the front side, the rear side, the left side, and the right side of the cap cover at least part of a front side, a rear side, a left side, and a right side, respectively, of the housing, and thereby prevents debris falling into an inner chamber of the housing; and wherein the mounting device projects outwards from the housing;

wherein the cap has a first opening in the top of the cap which allows the cap to be slipped on to the housing, by passing the mounting device through the first opening in the top of the cap to cover the one or more openings at the top of the housing, and allows the cap to be slipped off of the housing, by passing the mounting device through the first opening in the top of the cap; and wherein the mounting device projects outwards from the cap through the first opening in the top of the cap when the cap is attached to the housing, so that the cap covers the one or more openings at the top of the housing.

2. The electrical hair trimmer of claim 1 wherein the first opening in the top of the cap has a dash shape.

3. The electrical hair trimmer of claim 1 wherein the cap has a second opening in the top of the cap which allows a further device fixed to the housing to pass through the second opening in the top of the cap while the mounting device passes through the first opening in the top of the cap in order to attach the cap onto the housing, so that the top of the cap covers the one or more openings at the top of the housing.

4. The electrical hair trimmer of claim 3 wherein the first opening in the top of the cap has a dash shape; and the second opening in the top of the cap has a T shape.

5. The electrical hair trimmer of claim 1 wherein the first opening in the top of the cap has a T shape.

6. The electrical hair trimmer of claim 1 wherein each of the front side, the rear side, the left side, and the right side of the cap has outer ridges; and the top of the cap lacks outer ridges.

7. The electrical hair trimmer of claim 1 wherein wherein the electrical hair trimmer is formed by modifying an original electrical hair trimmer by cutting off a top portion of the original electrical hair trimmer and removing the top portion of the original electrical hair trimmer; and wherein the electrical hair trimmer is formed so that at least a portion of the mounting device which resides within the top portion of the original hair trimmer, lies outside of the housing and outside of the cap when the cap is attached to the housing of the electrical hair trimmer at the top of the housing so that the mounting device projects outwards from the top of the cap and from the housing.

8. A method comprising the steps of:

passing a mounting device of an electrical hair trimmer through a first opening in a top of a cap, wherein the mounting device is configured to have a blade mounted on the mounting device; and attaching the cap to a housing of the electrical hair trimmer at a top of the housing so that the top of the cap covers one or more openings at the top of the housing and thereby prevents debris falling into an inner chamber of the housing, and the mounting device projects outward from the top of the cap and from the housing;

wherein the cap includes a front side, a rear side, a left side, a right side and the top, wherein the top is fixed to the front side, the rear side, the left side, and the right side, so that the top protrudes inwards from the front side, the rear side, the left side, and the right side;

wherein the cap is configured to be attached and detached from the housing so that when the cap is attached to the housing the top of the cap covers the one or more openings at the top of the housing, while the front side, the rear side, the left side, and the right side of the cap cover at least part of a front side, a rear side, a left side, and a right side, respectively, of the housing.

9. The method of claim 8 wherein the first opening in the top of the cap has a dash shape.

10. The method of claim 8 further comprising passing a further device of the electrical hair trimmer through a second opening in the top of the cap while the mounting device passes through the first opening in the top of the cap in order to attach the cap onto the housing, so that the top of the cap covers the one or more openings at the top of the housing.

11. The method of claim 10 wherein the first opening in the top of the cap has a dash shape; and the second opening in the top of the cap has a T shape.

12. The method of claim 8 wherein the first opening in the top of the cap has a T shape.

13. The method of claim 8 wherein each of the front side, the rear side, the left side, and the right side of the cap has outer ridges; and the top of the cap lacks outer ridges.

14. The method of claim 8 further comprising forming the electrical hair trimmer prior to attaching the cap to the housing of the electrical hair trimmer at the top of the housing; and wherein the electrical hair trimmer is formed by modifying an original electrical hair trimmer by cutting off a top portion of the original electrical hair trimmer and removing the top portion of the original electrical hair trimmer; and wherein the electrical hair trimmer is formed so that at least a portion of the mounting device which resides within the top portion of the original hair trimmer, lies outside of the housing and outside of the cap when the cap is attached to the housing of the electrical hair trimmer at the top of the housing so that the mounting device projects outwards from the top of the cap and from the housing.

* * * * *